United States Patent [19]

Basevi

[11] Patent Number: 4,560,392

[45] Date of Patent: Dec. 24, 1985

[54] NOISE MAKING BALLOON VALVE

[76] Inventor: John L. Basevi, c/o Apartment 031913, Block 126, Avenue 3, Ang Mo Kio, Singapore, 2056

[21] Appl. No.: 554,329

[22] Filed: Nov. 22, 1983

[51] Int. Cl.[4] ..... A63H 29/10; A63H 5/00; A63H 3/06

[52] U.S. Cl. ..... 446/186; 446/213; 446/224

[58] Field of Search ..... 446/220, 221, 222, 223, 446/224, 225, 226, 186, 216, 213, 188; 137/223, 246; 116/112, 137 R, DIG. 7

[56] References Cited

U.S. PATENT DOCUMENTS

| | | | |
|---|---|---|---|
| 584,443 | 6/1897 | Wilmont . | |
| 845,244 | 2/1907 | Lorenz | 137/246 |
| 1,158,206 | 10/1915 | Griffith . | |
| 1,251,758 | 1/1918 | Dayton . | |
| 1,313,705 | 8/1919 | Lerch | 446/186 |
| 1,595,441 | 8/1926 | Zenger . | |
| 1,760,022 | 5/1930 | Stowe . | |
| 1,874,915 | 8/1932 | Crowley . | |
| 2,263,342 | 11/1941 | Lewis . | |
| 2,845,747 | 8/1958 | Wintriss . | |
| 2,893,165 | 7/1959 | Bailey . | |
| 3,095,669 | 7/1963 | Barricks . | |
| 3,670,690 | 6/1972 | Swanson . | |
| 3,768,501 | 10/1973 | Elson et al. . | |
| 4,015,622 | 4/1977 | Pagani . | |
| 4,094,347 | 6/1978 | Ikemoto . | |
| 4,194,461 | 3/1980 | Kubiatowicz . | |

FOREIGN PATENT DOCUMENTS

| | | | |
|---|---|---|---|
| 2107066 | 8/1971 | Fed. Rep. of Germany . | |
| 2063280 | 7/1979 | Fed. Rep. of Germany | 137/246 |

*Primary Examiner*—Mickey Yu

*Attorney, Agent, or Firm*—Steele, Gould & Fried

[57] ABSTRACT

A noise making valve for a toy balloon includes a casing enclosing a moveable valve body and a resonant reed disposed upstream of the valve body. A perforated membrane substantially closing the end of the casing opposite the balloon is depressable to lift the valve body from its seat, causing emission of a tone. The valve body is positively enclosed in the casing, and the reed is protected by folded-over tabs, such that no part of the valve is removable by the user. Safety features also include an enlarged trumpet shape and a restriction preventing a complete sudden ejection of the valve from the balloon.

15 Claims, 30 Drawing Figures

NOISE MAKING BALLOON VALVE

BACKGROUND OF THE INVENTION

1. Field of the Invention

This invention relates to the field of noise making apparatus for placement in the wall of an inflatable body, check valves for inflating such bodies, and in particular to a noise making valve for removable use with toy balloons.

2. Description of the Prior Art

The general concept of employing a reed in a balloon valve is known in the art. Reference can be made to Offenlegungsschrift No. 2,107,066, to the present Applicant, for a disclosure of a valve and reed according to this general description. U.S. Pat. No. 2,893,165-Bailey teaches the use of a valve and reed apparatus as a signalling device, rather than as a toy. Unfortunately, neither device is useful as a toy because both the devices are enclosed in relatively small cylindrical casings which are quite unsafe for use with toy balloons. Users of toy balloons, usually children, are inclined to dislodge the valve casing from the balloon when inflating or manipulating the balloon, and are in danger of inhaling the balloon valve, resulting in injury to the user.

Check valves for balloon inflation, that is, valves without provision for a noise maker, are shown in U.S. Pat. Nos. 1,251,758-Dayton and 1,158,206-Griffith. The valves of these devices are quite small, and are entirely enclosed within the neck of the balloon. A resilient flap is mounted in a cylindrical casing to block air flow axially, through the neck of the balloon. Only the resilient frictional attachment between the balloon neck and the inserted check valve prevents the valve from being immediately ejected, and possibly inhaled by the user. It will be appreciated that the user's usual sequence in blowing up a balloon is to exhale into the balloon and immediately inhale in order to continue filling the balloon. Therefore, should the user over-inflate the balloon, the valve may be easily ejected just as the user inhales.

Safety is known to be a major interest in the design of children's toys in general and balloon valves in particular. Of course, the valve must seal dependably and must dependably emit noise. The interests in safety and usefulness, however, are sometimes inadequately served when cost is considered. The nature of the product is such that undue complexity, whether for increased dependability or safety, adds too much expense to justify the improvement. Therefore, it is particularly important in this art that cost be minimized.

The aforesaid Offenlegungsschrift No. 2,107,066, to Applicant, employs the general concept of a balloon valve with an anti-ejection feature. At FIG. 10 thereof, a noise maker is included as well. Even with the additional complexity of a three piece case construction, the device of the German patent fails to fully preclude the possibility of ejection and inhalation or swallowing, fails to protect the reed against removal or damage, and fails to provide a dependable seal between the valve body and valve casing.

The present invention improves over devices such as those of the prior art in a number of ways. A more-effective valve seal, and protection of the reed add to the dependability of operation. A flared trumpet shape at the downstream end of the valve casing is operative as a stable base member, and is also much too large to be inhaled or swallowed. Nevertheless, the user can inflate the balloon directly through the valve casing, stand the balloon on a surface or attach the balloon to a string or stick, cause emission of a noise, and in other respects enjoy all the advantages which might be sought from toy balloons, at minimal expense and inconvenience.

SUMMARY OF THE INVENTION

It is an object of the invention to provide an improved noise making balloon valve which is safe and inexpensive.

It is also an object of the invention to provide a safe, inexpensive noise making valve which is entirely dependable for noise making and positive sealing of the inflated balloon.

It is another object of the invention to achieve the foregoing objects in a device wherein the internal workings are concealed safely and isolated from inquisitive children.

It is yet another object of the invention to inexpensively protect the internal workings of the valve from rough handling and the like.

These and other objects are accomplished by a valve for insertion in the neck of a toy balloon, comprising a casing having a balloon-engagable end and a user-accessible end, the casing defining an air flow path and having an internal annular surface defining a seat; a valve body disposed in the casing and movable between a closed position in which the valve body is disposed against the valve seat to seal the flow path, and an open position in which the valve body is moved away from the valve seat to open the flow path, the valve body being biased by gas pressure in the balloon to the closed position when the balloon is inflated; and, a resonant reed mounted in the casing and operable to emit a noise in response to gas flow. The casing is preferably flared at the user-accessible end to form a trumpet of sufficient size to form a stable base, the trumpet being too big to be swallowed even if the valve is suddenly ejected. A membrane substantially closes the user-accessible end of the casing, the membrane having at least one opening to gas flow and the membrane being manually depressable to thereby lift the valve body from the valve seat. Tabs protect the balloon-engagable end of the casing, housing the reed, the tabs and membrane together concealing and protecting the internal workings. Promotional indicia can be conveniently printed on the inside face of the membrane if made transparent. A viscous, non-drying seal compound residing in an annular groove at the valve seat provides an absolute gaseous seal at the relatively low pressures encountered.

BRIEF DESCRIPTION OF THE DRAWINGS

There are shown in the drawings the embodiments which are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
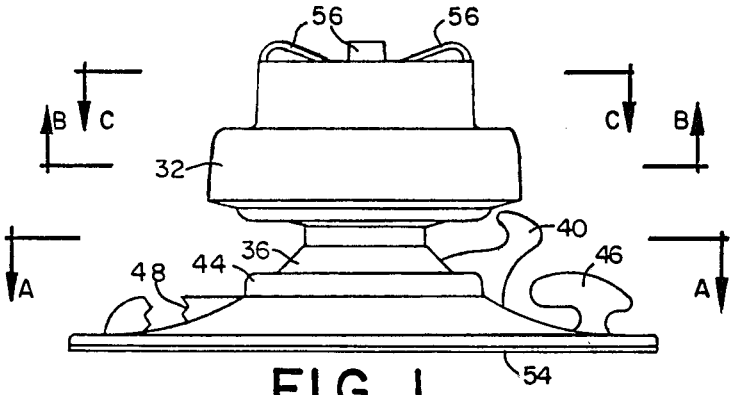
FIG. 1 is a side elevation view of an embodiment of the valve apparatus according to the invention.

The device of the invention, as shown generally in FIG. 1, comprises a casing 30 having an intermediate enlarged portion 32 to be enclosed within the neck of a balloon, and a flaring trumpet portion 36 extending axially from the neck of the balloon. A retaining mechanism comprising hook 40, which interacts with the external contour of the casing enlargement 32, prevents complete ejection of the device in the event of over-inflation or slippage. The device includes a retaining cleat 46 for attachment to a string and transversely-threaded flange 48 for attachment to a stick. Preferably, bent over tabs 56 prevent access to the internal portions of the device from the balloon side; and, covering membrane 54 prevents access from the user side.

The device may be installed on a deflated balloon, whereupon the user employs the valve of the device as a check valve to pass air or gas such as helium to inflate the balloon, and to hold the air or gas against the resilient pressure of the stretched balloon material. The device can also be installed in an already-inflated balloon, however, it will be appreciated that steps must be taken to prevent the escape of air or gas during installation. When installed on an inflated balloon, the device may be operated to allow controlled release of the air or gas, and emission of a noise.

Figure 2:
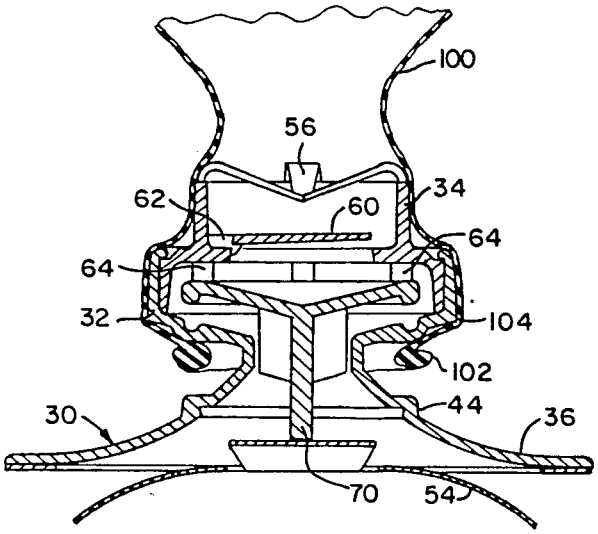
FIG. 2 is a cross sectional view of the valve unit of FIG. 1, shown fitted into a balloon and operative to expel air from the balloon.

The internal workings of the valve are shown in section in FIG. 2. FIG. 2 also depicts the valve in the open position, that is, while expelling air from balloon 100 through the device of the invention. Balloon 100 is retained on the device of the invention by neck 104 of balloon 100 enclosing the enlarged portion 32 of casing 30. Neck portion 104, including the rolled edge 102 of the balloon, exerts sufficient pressure radially inwards to preclude axial movement of the substantially cylindrical casing 30 with respect to balloon 100. Such axial movement would otherwise cause casing 30 to be ejected from neck 104 of balloon 100.

When the valve of the invention is opened as shown in FIG. 2, a generally axial flow of air from balloon 100 through casing 30 causes noise due to the vibration of resonant reed 60, placed to partially occlude the air flow path. Reed 60 is mounted to the casing only at one edge 62, the resonant frequency of reed 60 being determined by the weight, material, and dimensions of the reed and its connection 62. The reed is a relatively delicate portion of the device, which can be made inoperative if displaced from its mounting at an area of restricted cross section, and accordingly, tabs 56 are provided to prevent easy access to reed 60.

Casing 30 is preferably formed in two parts, snap fitted together, thereby making it impossible to remove or eject the movable valve body 70. As shown in FIG. 2, the upper reed-enclosing position 34 has a downwardly extending flange having an abrupt transition at its edge, over which an upwardly-extending flange of enlargement 32 resiliently locks, the extreme edge of the upward flange engaging the transition of the downward flange. Valve body 70 is therefore securely locked between reed enclosing section 34 and enlarged section 32 upon assembly.

Valve body 70 is movable between an upward position as shown in FIG. 2, resting against spacers 64, and a downward position in which valve body 70 sealably engages casing 30, to prevent the escape of air from balloon 100. Valve body 70 is depressed into its upward position manually, preferably by pressing the central position of slotted membrane 54.

Figure 3:
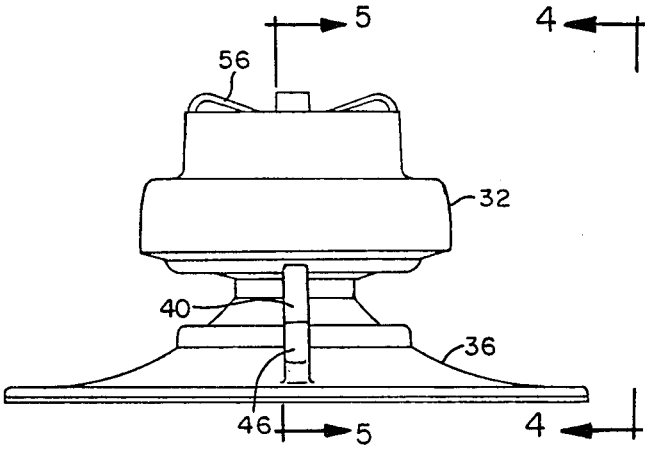
FIG. 3 is a side elevation view of the valve of the invention.
Figure 4:
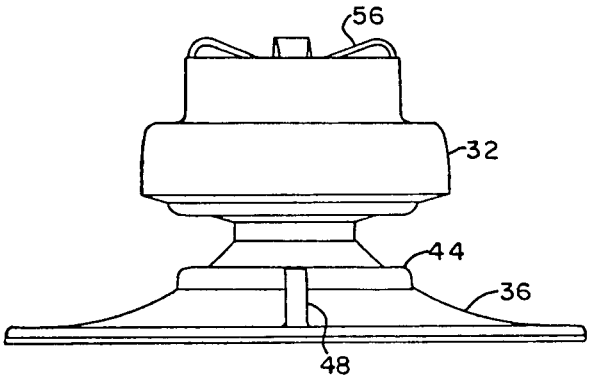
FIG. 4 is a side elevation view from the opposite side as in FIG. 3.

The external dimensions of the apparatus, as shown in FIGS. 1, 3 and 4, are chosen to provide a sufficient enlargement 32 to engage securely the neck of the balloon. The portion of largest diameter, namely, the opening of the trumpet 36 of casing 30 is chosen to be substantially larger than could be inhaled or swallowed by a child, at least 32 millimeters. Similarly, hook 40 and string cleat 46 are made thick enough, that with due regard to the material from which the unit is made (e.g., hard plastic), these protruding portions will not easily break off. Threaded flange 48 (shown in FIG. 1) is of substantially the same thickness as hood 40 and cleat 46.

Figure 5:
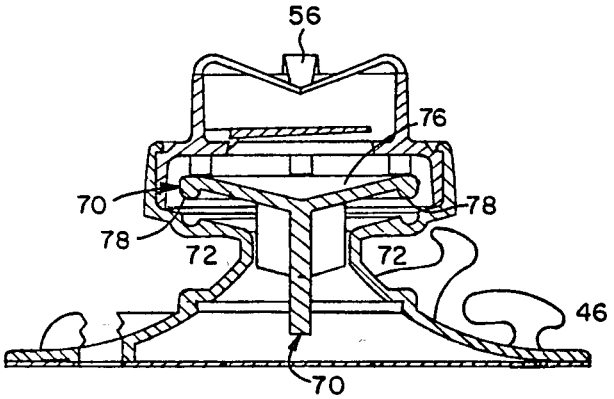
FIG. 5 is a section view taken along lines 5—5 in FIG. 3.
Figure 8:
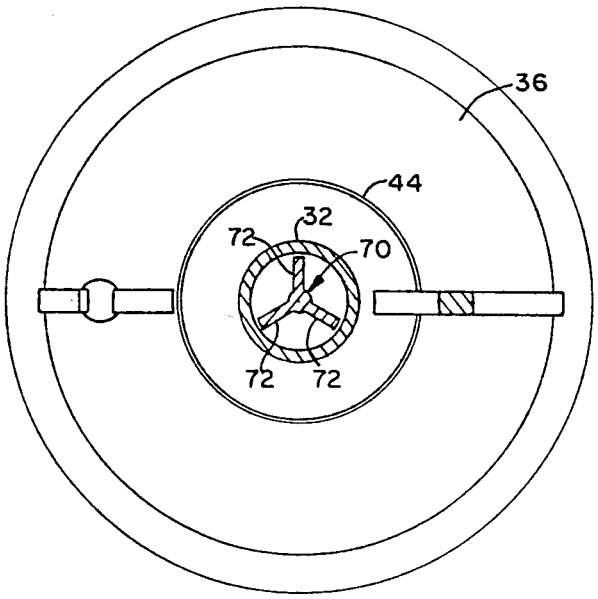
FIG. 8 is a section view taken along line A—A in FIG. 1.

Before installation or during actual inflation, as shown in FIG. 5, valve body 70 may rest against spacers 64, the valve being open to air flow. After inflation, the pressure of air within balloon 100, downward against valve body 70, biases the valve into a closed position. It will be appreciated that when the valve body 70 rests against spacers 64, air may pass between the spacers, around the valve body and out of the unit through the trumpet portion. Valve body 70 is comprised of a circular portion 76 for sealing the valve, and attached downwardly-extending legs 72, angularly spaced to allow air flow when the valve is opened. As shown in cross-section in FIG. 8, the valve body preferably includes three such legs 72, forming a generally-cylindrical but open-to-air flow body.

Figure 6:
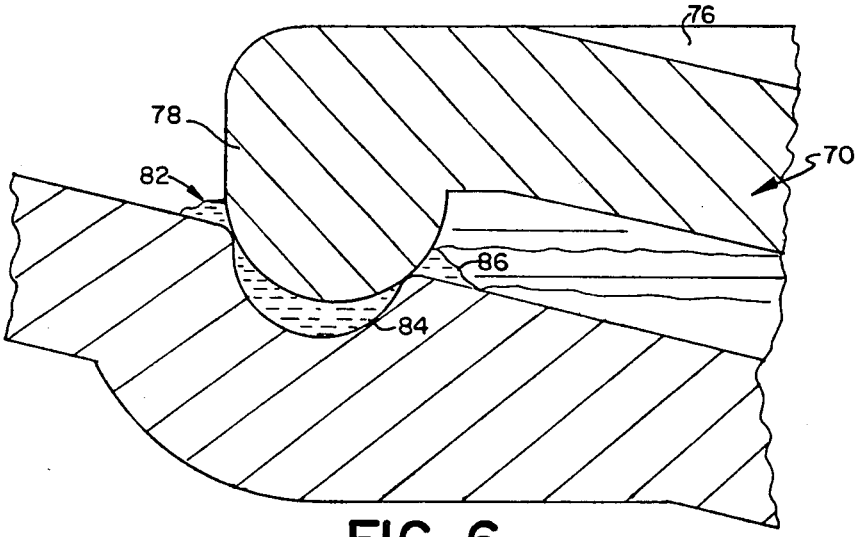
FIG. 6 is a partial section view in accordance with FIG. 5 showing the area of the valve seat in detail.

When the valve of the device is closed, valve body 70 rests against casing 30, sealing the axial opening against passage of gas or air. In particular, the downwardly-directed flanged edge 78 of valve body 70 fits against a complementarily-shaped valve seat 82. Valve seat 82 is comprised of an annular groove 84, in which viscous, non-drying seal material 86 is disposed. As shown in FIG. 6, groove 84 forms a receptacle for the sealing material 86. When valve body 70 and flange 78 rest against valve seat 82, a portion of sealing material 86 is displaced from the annular groove 84, to contact flange 78 and prevent the passage of air. It will be appreciated that viscous sealing material 86 also closes any leaks which would be presented by misalignment or warping in flange 78, or in burrs or other small imperfections in the interacting portions of the valve.

Figure 7:
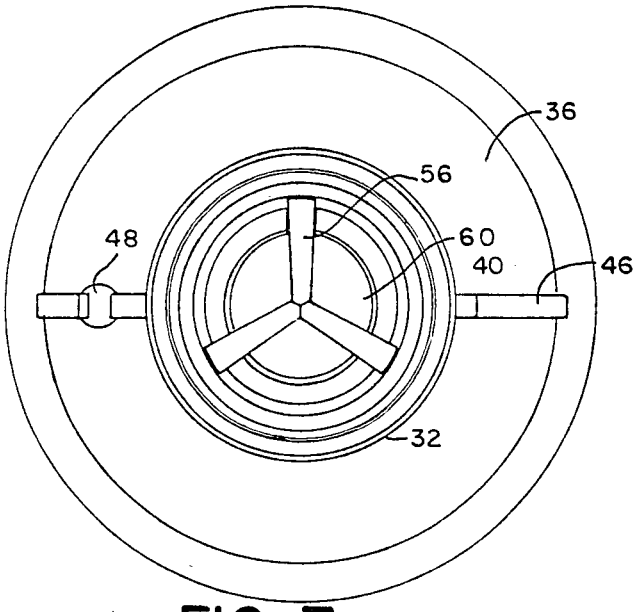
FIG. 7 is a top plan view of the apparatus of the invention.

When the device of the invention is removed from the balloon, reed 60 is visible, but protected by tabs 56. Three tabs 56 are shown in FIG. 7. The number allows sufficiently close placement of tabs 56 to prevent any substantial damage to reed 60 due to insertion of fingers, pencils, or other commonly-available objects.

Figure 9:
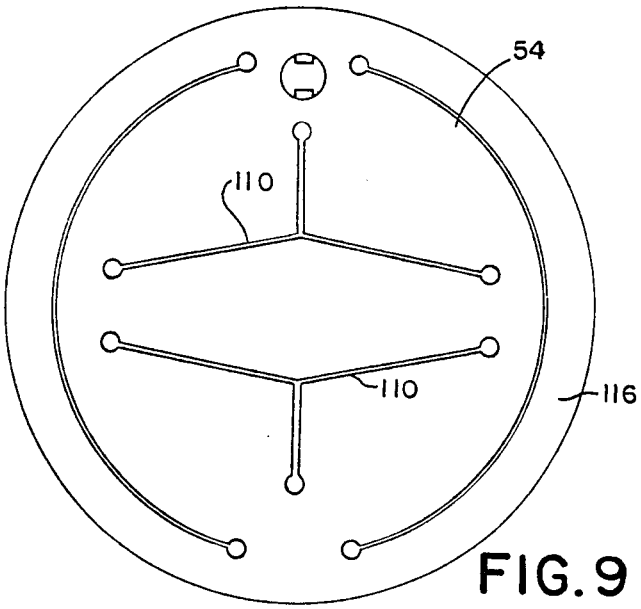
FIG. 9 is a bottom plan view of the apparatus of the invention.

From below, the internal workings of the device are also preferably obscured. As shown in FIG. 9, membrane 54 substantially covers the opening formed by trumpet 36. A central area 112 of membrane 54 is integrally attached to the remainder of the membrane only near the edges of the trumpet, and only at portions of membrane 54 which are deformable upwards by means of peripheral slots 114, adjacent edge 116, which portion is actually attached to trumpet 36. Slots 110, which define central depressable portion 112, also divide the remaining portions of membrane 54, to allow passage of air. Membrane 54 may be of any air-permeable material, provided a sufficient resilience is allowed for depression of valve body 70, and also provided that the air flow from a deflating balloon can be accommodated. For example, resilient screen material, or other permeable material, or perforated material having a centrally movable portion would suffice.

Figure 10:
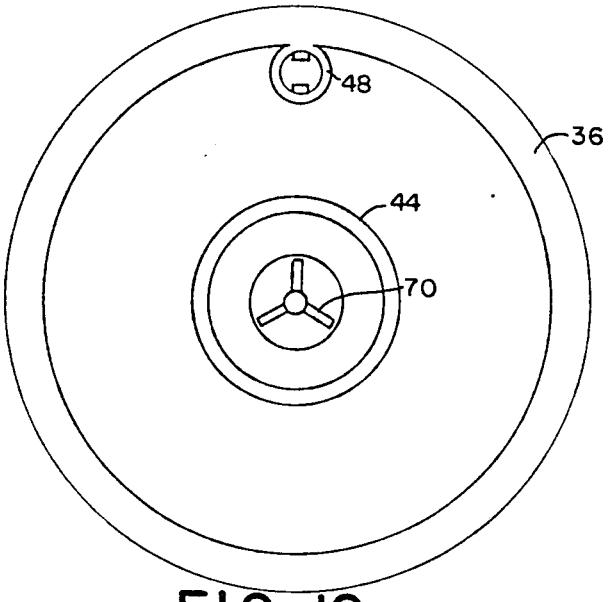
FIG. 10 is a bottom plan view of the apparatus having the bottom membrane removed.

As shown in FIG. 10, trumpet 36 ends in a edge portion 116, to which membrane 54 may be easily attached, for example by glue or heat sealing. Similarly, threaded hole 48, provided for attachment to a stick, likewise has a peripheral portion which can be glued directly to membrane 54. A ridge 44 may be provided in the contour of trumpet 36, for additional strength.

Figure 11:
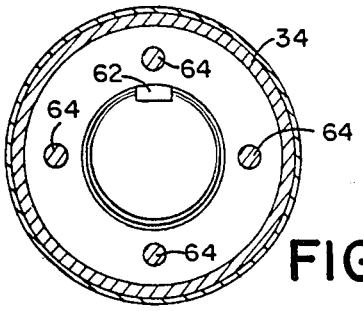
FIG. 11 is a section view taken along lines B—B in FIG. 1 showing the attachment of the resilient reed member.
Figure 12:
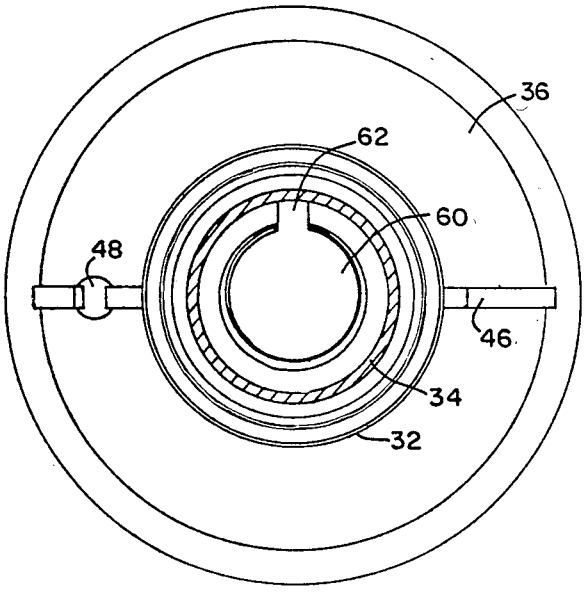
FIG. 12 is a section view taken along lines C—C in FIG. 1.

FIG. 11 shows the spacers 64 and reed 60 from below, and FIG. 12 shows the reed from above. With reference to FIG. 12, reed 60 need only be a movably-attached flap substantially blocking the air passage along the axis of the valve unit. It is presently preferred that reed 60 be an integral part of the reed enclosure portion 34 of casing 30, folded over at a relatively-thin connection 62, whereby reed 60 is resiliently-mounted. Passage of air around reed 60 causes the reed to vibrate between a more open position in which air flow presses it downwards, and a more closed position in which air flow becomes restricted, thereby decreasing the pressure and continuing vibration of the reed in its orifice.

Figure 13:
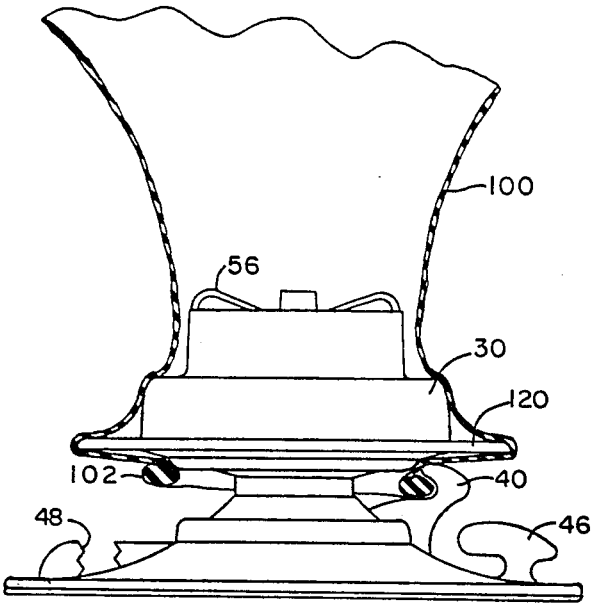
FIG. 13 is a sectional view of an alternative embodiment of the device, as installed in a balloon.
Figure 15:
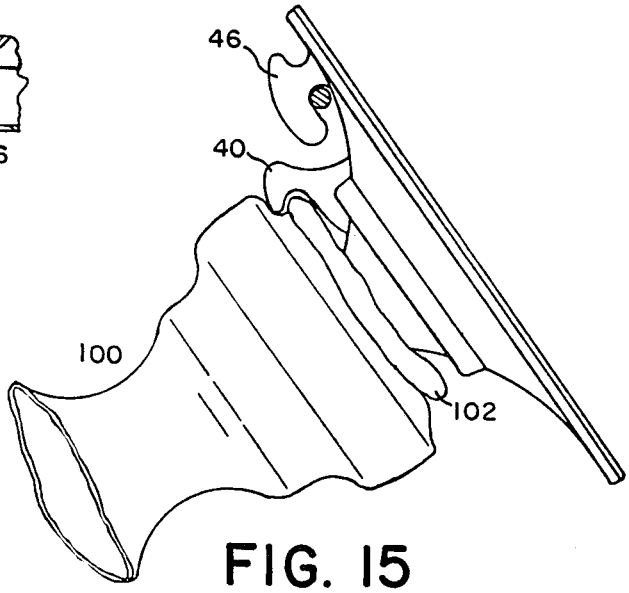
FIG. 15 is an elevation view of the device according to FIG. 1, installed in a balloon.

An alternative embodiment of the invention is shown in FIG. 13. In this embodiment, recommended for use with balloons having oversized neck openings, an extending annular flange 120, attached to casing 30 adjacent hook 40, provides further safety against accidental ejection of the balloon valve. In order to be ejected from balloon 100, casing 30 must be displaced axially, allowing balloon 100 to slip axially backwards. As a result of extending flange 120, any such axial movement must be accompanied by a radial outward movement of the enlarged edge 102 of balloon 100. This movement is exactly what is restricted by hook 40, thereby making the embodiment of FIG. 13 particularly safe against ejection. The same phenomena, that is, restriction of the tubular edge 102 of balloon 100, is operative to a greater or lesser extent in all the disclosed embodiments hereof. The basic embodiment, shown in FIG. 15, likewise employs hook 40 to prevent complete ejection by holding edge 102 of balloon 100 against movement. Even if the device is partially ejected from balloon 100, hook 40 will retain at least a portion of edge 102, such that the user is not in danger of inhaling or swallowing the device.

Figure 14:
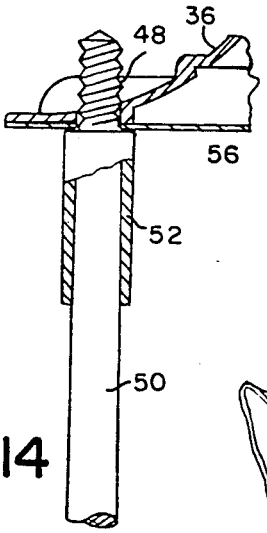
FIG. 14 is a partial section view of the device of the invention, as attached to a stick.

In addition to the safety provision of hood 40, casing 30 (in particular trumpet 36), is provided with a threaded hole 48, for interaction with a balloon-holding stick 50, and also with a cleat 46, to be attached to a string. As shown in FIG. 14, stick 50 is preferably attached to threaded hole 48 by means of an additional threaded end 52 for stick 50. End 52 and stick 50 may be attached by gluing.

Figure 16:
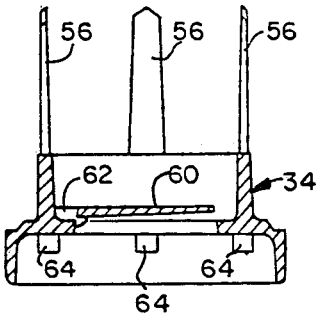
FIG. 16 is a section view of a part of the valve casing, showing an intermediate step of manufacture.
Figure 17:
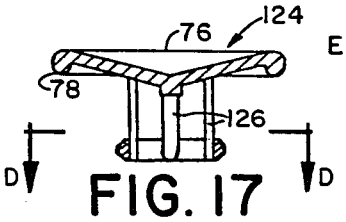
FIG. 17 is a section view of an alternative embodiment of the valve body of the invention.
Figure 18:
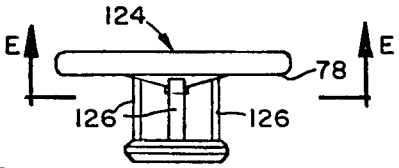
FIG. 18 is an elevation view of the valve according to FIG. 17.
Figure 19:
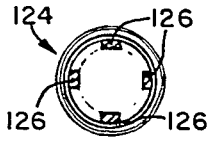
FIG. 19 is a section view taken along lines D—D in FIG. 17.
Figure 20:
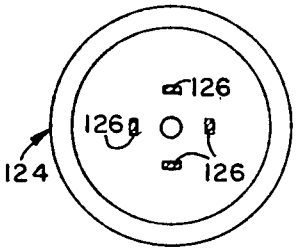
FIG. 20 is a section view taken along lines E—E in FIG. 18.

As noted hereinabove, reed 60 is preferably made as an integral part of the reed enclosing portion 34 of casing 30, and is attached thereto by means of a relatively small connecting portion 62. This portion is more easily molded if tabs 56 are bent over after molding, as shown in FIG. 16. Inasmuch as the entire device is preferably formed of plastic, tabs 56 can normally be deformed into protective position by heating and bending them inwards. A similar operation can be employed if desired to displace the body of reed 60 slightly from the orifice in reed enclosure member 34 in which the reed vibrates.

FIGS. 17–20 illustrate an alternative embodiment of valve body 70. As shown in FIGS. 17–20 valve body 124, unlike valve body 70, employs a plurality of light weight connection members 126 between the circular valve portion 76 and the portion of valve body 124 which is manually depressable by the user. In other respects, valve body 124 operates much the same as valve body 70 in that a flanged edge 78 cooperates with a complementarily shaped valve seat having an annular groove and viscous non-drying material. The leg portions 126 leave an open area for air flow and can even be used to surround a transversely-disposed pin (not shown), making further captive of valve body 124.

Figure 21:
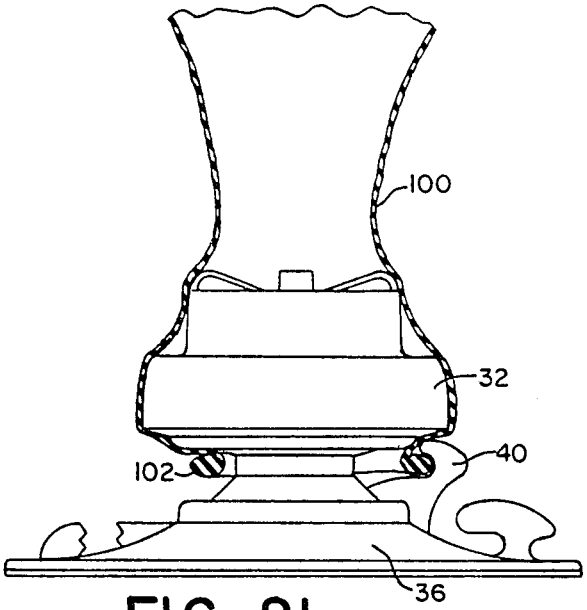
FIG. 21 is an elevation view of the valve, the balloon being shown in section.
Figure 22:
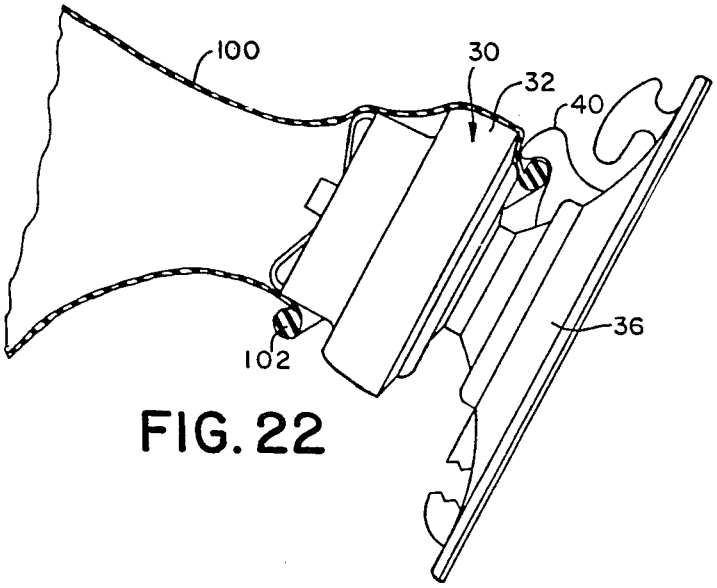
FIG. 22 is a sectional view illustrating installation of the device of the invention.

A comparison of FIGS. 21 and 22 illustrates the partial ejection of the device from balloon 100. Even when air pressure within balloon 100 becomes sufficient to force enlarged portion 32 of casing 30 through the opening defined by the balloon neck, hook 40 nevertheless retains at least a portion of balloon 100, and especially rolled edge 102, which remains confined between hook 40 and enlargement 32.

Figure 23:
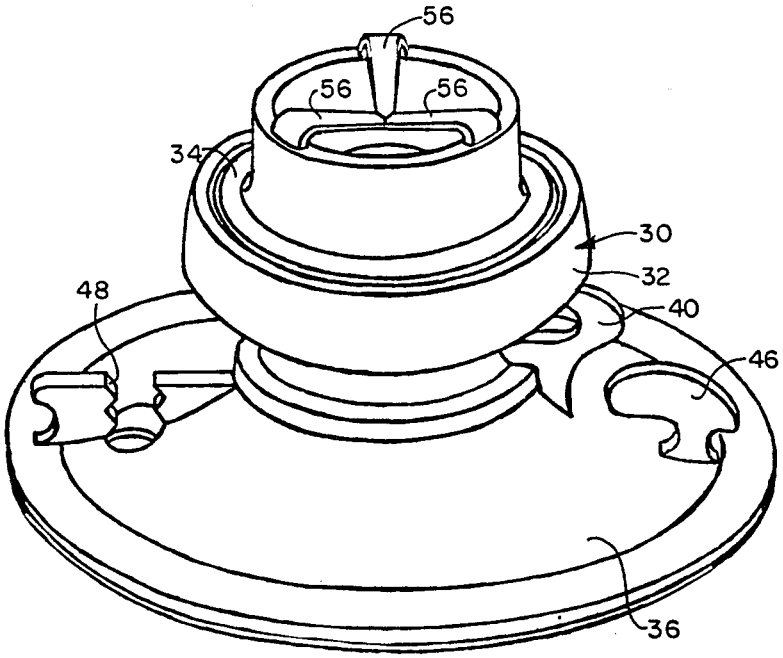
FIG. 23 is a perspective view of the device of the invention.
Figure 24:
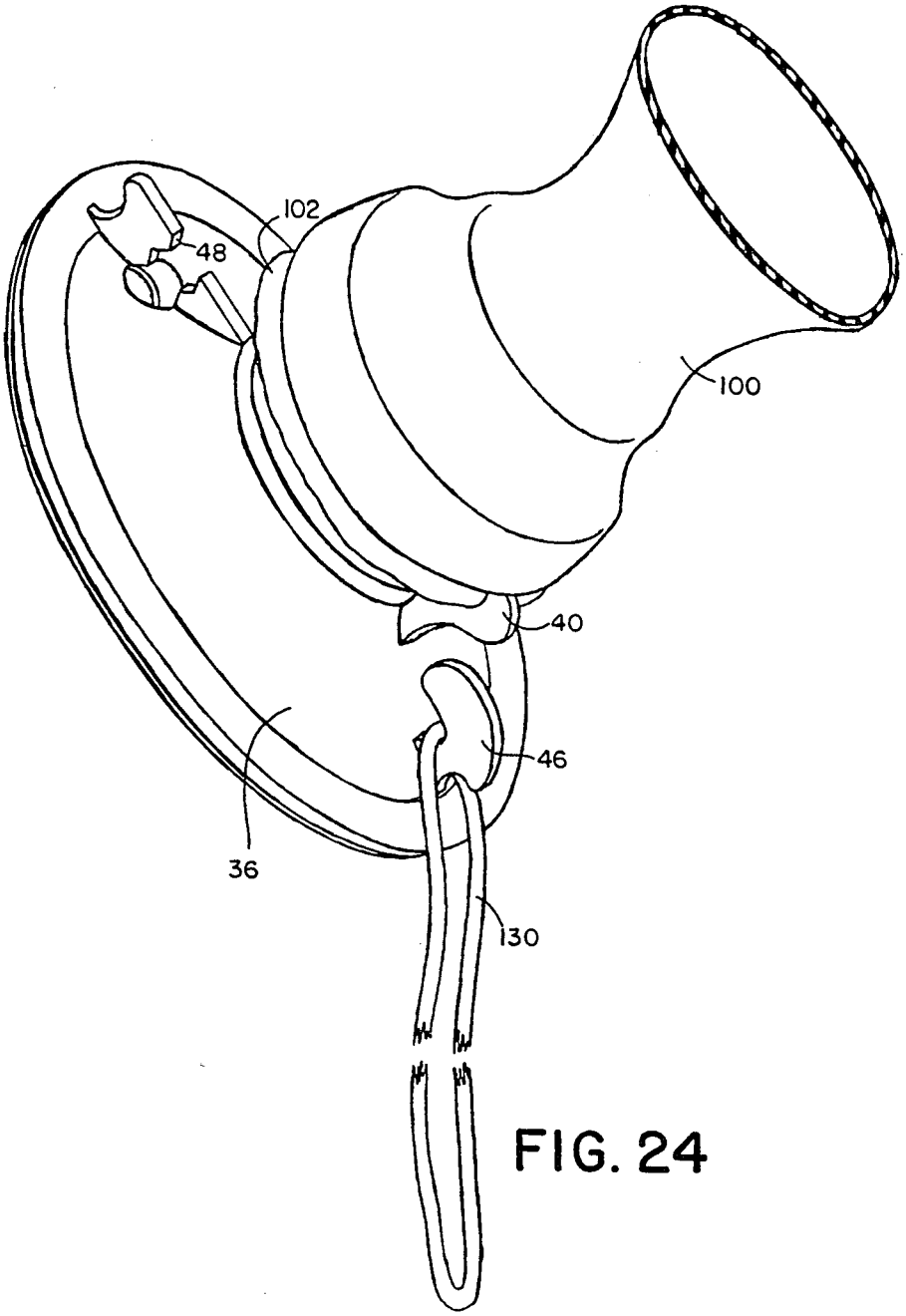
FIG. 24 is a perspective view of the device as installed, and attached to a carrying string.

The overall device as shown in perspective in FIGS. 23 and 24. As noted, the external dimensions must be large enough to preclude inhalation or swallowing. It will be appreciated that the device can otherwise be dimensioned in accordance with the expected size of balloons, the only requirement being that the balloon neck be stretched substantially in order to provide sufficient pressure over enlarged portion 32 to prevent ejection of the device. Although hook 40 will prevent full ejection, reliable operation requires that such ejection be an infrequent occurrence in any event.

The flanged portion forming string cleat 46, hook 40 and threaded stick-engaging member 48 are all preferably placed along the same diameter to assist in the molding operation. Enlarged portion 32 preferably snap fits over the reed-enclosing portion 34 of casing 30, very positively connecting the casing parts 32, 34 around valve body 70. In this manner, not only are the reed and valve body safe from damage, but they cannot be broken off or removed and swallowed.

The device of the invention is, of course, equally applicable to helium balloons. An endless ribbon 130 of stretchable plastic material forms a loop which may be simply passed over string cleat 46. Although the balloon tends to rise vertically, the slightly off-axis placement of cleat 46 is such that the larger portion of cleat 46 easily retains the string, against the tendency of the balloon to rise.

Figure 25:
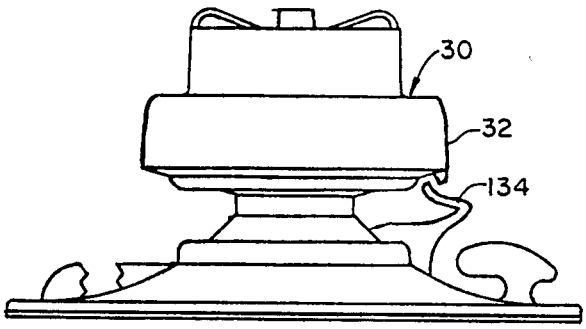
FIG. 25 is a side elevation view of an alternative embodiment of the invention.
Figure 26:
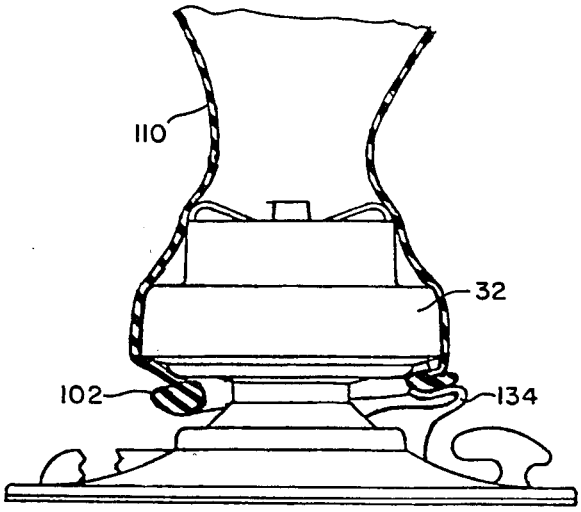
FIG. 26 is a sectional view illustrating installation of the device according to FIG. 22.
Figure 27:
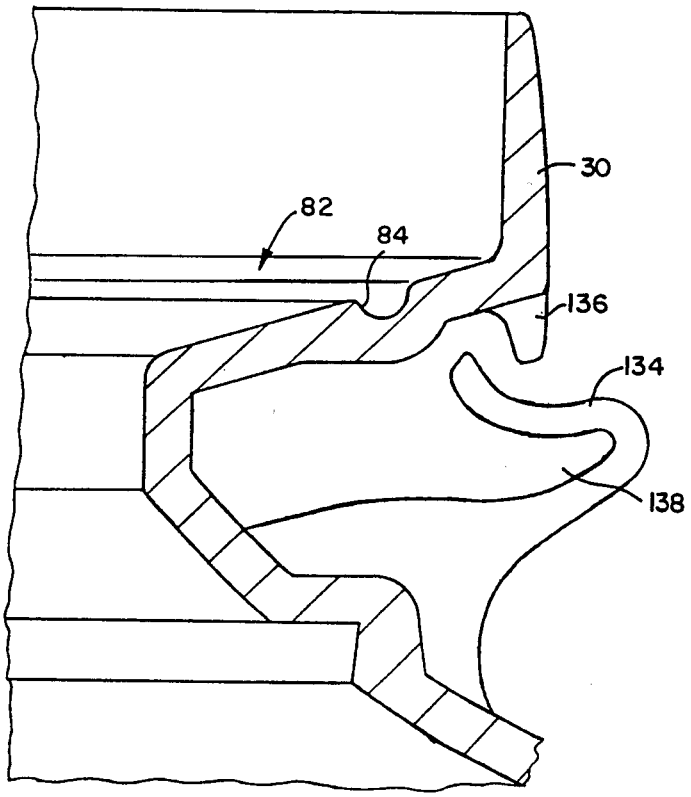
FIG. 27 is a detail sectional view of the device according to the embodiment of FIG. 25.
Figure 28:
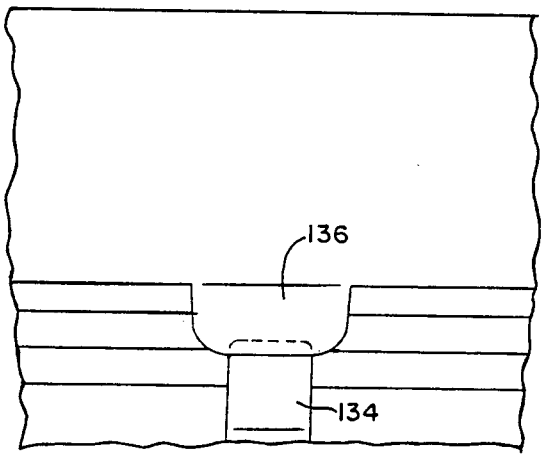
FIG. 28 is a side elevation from the right with respect to FIG. 27.
Figure 29:
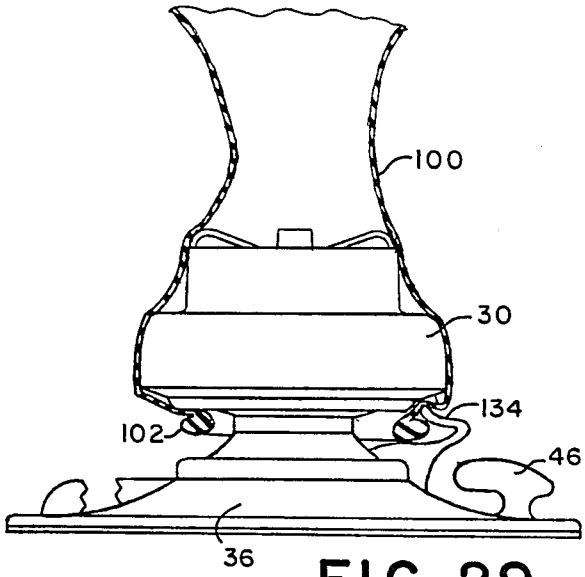
FIG. 29 is a side elevation showing the completed attachment of balloon and valve of FIG. 25.
Figure 30:
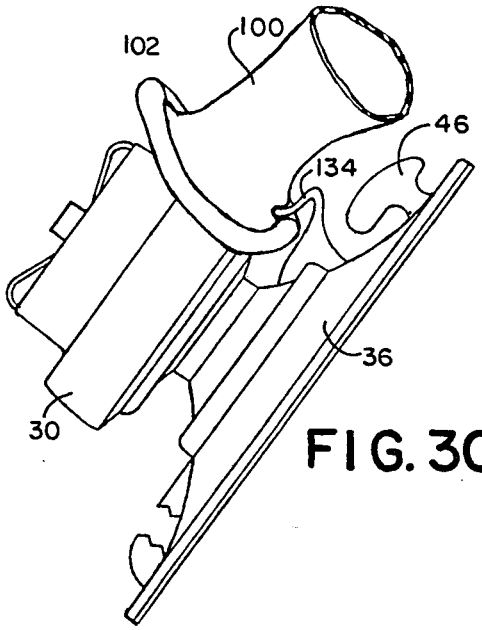
FIG. 30 is a side elevation showing an intermediate step in the attachment of FIG. 29.

An alternative embodiment of the invention is shown in FIGS. 25–30. Hook 134, having a thin and resilient end portion, is closely disposed against enlarged portion 32 of casing 30. The spacing between hook 134 and casing 32 is quite small, and hook 134 must be actually deformed in order to force edge 102 of balloon 110 into the engaged area between hook 134 and casing 30. As shown in FIG. 25, casing 30 is preferably provided with an indented area against which hook 134 is closely disposed. FIG. 27 illustrates the close positioning of hook 134 and casing 30 in detail. A downwardly-extending edge 136 of casing 30, together with the outside contour of annular groove 84 of valve seat 82 defines a pocket in case 30 in which the end of hook 134 is disposed. Hook 134 is nevertheless deformable, whereby edge 102 may be forced into cavity 138 defined by hook 134 in casing 30. Edge 136 of casing 30 is preferably slightly lower than the protruding edge of hook 134, as shown in FIG. 28. FIGS. 29 and 30 show the engagement of the balloon by the entire casing, and by the hook 134, respectively, in a manner similar to FIGS. 21 and 22.

The device of the invention is preferably molded from plastic and is both durable and inexpensive. With the exception of membrane 54, all parts of the device are preferably injection molded in plastic. Membrane 54 may be a transparent or substantially transparent plastic sheet, and is preferably provided with promotional indicia on the inward or outward facing side thereof. For example, advertising materials, cartoon characters or the like may be provided on membrane 54, possibly including some indicia for the depressable portion such as the bulbous nose of a clown or the like.

The device of the invention is safe due to the balloon-retention hook, valve body captive design and protective tabs. The device is also dimensioned such that it cannot be inhaled or swallowed. The device is nevertheless quite dependable, and also inexpensive.

The invention having been disclosed in detail, additional variation will occur to persons skilled in the art to which the invention pertains. Reference should be made to the appended claims rather than the foregoing specification as indicating the true scope of the subject invention.

What is claimed is:

1. A valve for insertion in the neck of a toy balloon, comprising:

a casing having a balloon-engagable first end and a user-accessible opposite end, the casing defining a flow path and having an internal annular surface defining a valve seat, the casing being flared at the user-accessible end to form a trumpet, the casing supporting the balloon at the first end when placed with the trumpet on a support surface, and the trumpet having a large diameter with respect to a child's mouth and remaining portions of the casing;

a valve body disposed in the casing and movable between a closed position in which the valve body rests against the valve seat to seal the flow path, and an open position in which the valve body is moved away from the valve seat to open the flow path, the valve body being biased by gas pressure to the closed position when the balloon is inflated; and, a resonant reed mounted in the casing and operable to emit a noise in response to flow.

2. A valve for insertion in the neck of a toy balloon, comprising:

a casing having a balloon-engagable first end and a user-accessible opposite end, the casing defining a flow path and having an internal annular surface defining a valve seat, the casing being flared at the user-accessible end to form a trumpet, the casing supporting the balloon at the first end when placed with the trumpet on a support surface, and the trumpet being large with respect to a child's mouth;

a valve body disposed in the casing and movable between a closed position in which the valve body rests against the valve seat to seal the flow path, and an open position in which the valve body is moved away from the valve seat to open the flow path, the valve body being biased by gas pressure to the closed position when the balloon is inflated;

a resonant reed mounted in the casing and operable to emit a noise in response to flow; and, a membrane substantially closing the user-accessible end of the casing, the membrane having at least one air flow opening and the membrane being manually depressible against the valve body.

3. The valve of claim 1, wherein the reed is disposed at the balloon-engagable end of the casing, whereby the valve body is confined between the reed and the valve seat.

4. The apparatus of claim 3, further comprising at least one protective tab mounted to the casing and extending across the balloon-engagable end thereof.

5. The valve of claim 1, wherein the casing is formed in two pieces, the pieces being rigidly attached, and a first of the pieces comprising means for mounting the reed, a second piece comprising the trumpet, the valve body being captive between the first and second pieces.

6. The valve of claim 1, wherein the balloon is of a type having an enlarged rolled end, and further comprising a hook attached to the casing and forming a restriction with the casing for engaging said end, the restriction being narrower than the end, whereby the end must be resiliently deformed when engaged by the restriction, the restriction holding the balloon against complete ejection of the casing from the balloon.

7. The valve of claim 3, wherein the valve body has an annular flange resting against the valve seat in the closed position, the seat having an annular groove of complementary dimensions, the annular flange and annular groove forming an air-tight seal.

8. The valve of claim 7, further comprising a viscous, non-drying seal compound disposed in the annular groove.

9. The valve of claim 8, wherein said seal compound is grease.

10. The valve of claim 2, wherein the membrane is slotted to form a central portion depressable against the valve body and a peripheral portion displaceable outwards by action of air flow.

11. The valve of claim 10, wherein the membrane is substantially transparent and indicia is printed on an inner side of the membrane.

12. The valve of claim 10, wherein the casing is threaded adjacent an edge of the trumpet, the membrane having an opening aligned with the threads, whereby the casing may be carried upon a stick threaded into the casing.

13. The valve of claim 10, further comprising a cleat for engaging a string, mounted on the casing.

14. The valve of claim 10, further comprising an endless ribbon of stretchable plastic material affixed to the casing.

15. The valve of claim 10, wherein the casing, valve body, reed and trumpet are axially aligned.

* * * * *